US005738319A

United States Patent [19]

Grassi

[11] Patent Number: 5,738,319

[45] Date of Patent: Apr. 14, 1998

[54] ADJUSTABLE PLANTER BOX HANGER

[76] Inventor: Walter L. Grassi, 2410 Speyside Drive, Mississauga, Ontario, Canada, L5K 1X6

[21] Appl. No.: 814,581

[22] Filed: Mar. 10, 1997

[51] Int. Cl.[6] ..... A47B 96/06

[52] U.S. Cl. ..... 248/215; 40/39

[58] Field of Search ..... 248/215, 214, 248/278, 242; 47/39, 40

[56] References Cited

U.S. PATENT DOCUMENTS

| | | | |
|---|---|---|---|
| 4,074,882 | 2/1978 | Aderson | 47/39 X |
| 4,934,645 | 6/1990 | Breslow | 248/242 |
| 5,368,267 | 11/1994 | Howard | 47/40 X |
| 5,452,875 | 9/1995 | Kern | 248/242 |

*Primary Examiner*—Ramon O. Ramirez
*Attorney, Agent, or Firm*—Donald E. Hewson

[57] ABSTRACT

An adjustable planter box hanger for hanging a planter box at a selected angular position from a support structure having front and rear faces adjoined by a top brim portion comprises left and right hanging support brackets, each having a support structure engaging top portion for engaging the top brim portion of a support structure, and terminating in a downwardly turned lip portion for engaging the rear face of a support structure. Each of the left and right hanging support brackets also has a main downwardly depending leg having top and bottom ends and depending from the support structure engaging top portion, and an outwardly projecting support arm for receiving a planter box thereon. The outwardly projecting support arm terminates in an upwardly turned lip portion. An angle adjustment member has left and right bracket engagement member terminating at inner ends that are coterminous with and interconnected by a substantially straight cross member, for engaging, in use, the front face of a support structure. Each of the left and right bracket engagement members extends forwardly from the cross member. The left and right bracket engagement members are engagable forwardly and rearwardly along the bracket engagement members in selectively adjustable relation with the respective left and right hanging support brackets, such that any one of a plurality of fore and aft support positions can be selected, whereby each left and right hanging support bracket is displaced a selected distance from the front face of a support structure, thus permitting the downwardly depending leg to be disposed substantially vertically and the outwardly projecting support arm to be disposed substantially horizontally.

11 Claims, 3 Drawing Sheets

ADJUSTABLE PLANTER BOX HANGER

FIELD OF THE INVENTION

This invention relates to planter boxes and more particularly to planter box hangers for hanging a planter box at a selected angular position from a support structure, such as a fence.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

BACKGROUND OF THE INVENTION

Figure 1:
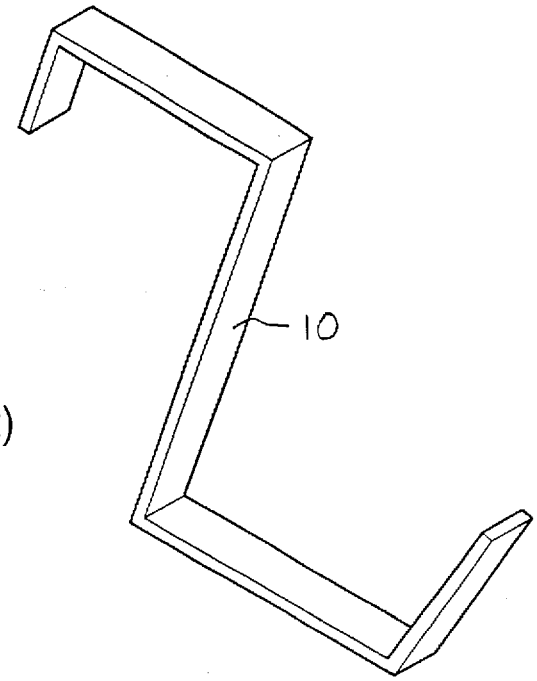
FIG. 1 (prior art)
FIG. 1 is a perspective view of a single prior art planter box hanger.
Figure 2:
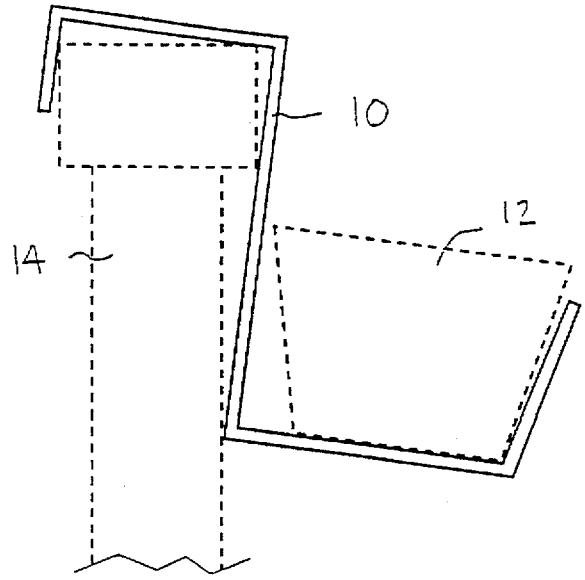
FIG. 2 (prior art)
FIG. 2 is a side elevational view of two conventional single prior art planter box hangers in use, supporting a planter box.

Gardening is a very popular past-time throughout most of the world. Often, in conjunction with a conventional garden, or in places where there is no room for a traditional garden, it is possible to use hanging planters to grow plants in. Conventional hanging planters comprise an elongate planter box 12, perhaps six inches to one foot wide and about one foot to four feet in length, which planter box 12 contains a suitable amount of soil for growing small plants, typically flowers. It is common for hanging planters to be hung from a fence 14, or the like, so that the plants are readily visible and also are raised from the level of the ground so as to be generally out of the reach of small animals. The elongate planter box 12 is supported on a fence 12, or the like, by means of a pair of separate metal brackets 10, which are essentially "S"-shaped, one of which is illustrated in FIG. 1 (prior art), disposed one toward each end of the planter box 12 as can be seen in FIG. 2 (prior art).

There are a number of problems associated with conventional hanging planters, in terms of how well the elongate planter box 12 is supported on a fence 12, or the like. First, the metal brackets 10, the planter box 12, the soil in the planter box 12, and the plants together, weigh a substantial amount, perhaps about twenty pounds to fifty pounds, or even more. All of this weight must be supported by the fence 12, with the hanging planter being located substantially on one side of the fence 12, not balanced on both sides of the fence 12. Accordingly, there is a significant moment arm loading on the fence 12 which tends to cause the conventional hanging planter to slant outwardly and downwardly. Such angling of the hanging planter is stopped only by contact of the bottom corner of the metal brackets 10 with the fence 12.

Further compounding this problem is the fact that the spacing of the boards or rails of a fence 12, or the like, makes it very difficult to properly support the two metal brackets 10. Also, the metal brackets 10 are of a standard, non-adjustable size, and therefore do not necessarily fit to the width of the fence 12 they are installed on, thus causing further unwanted angling of the metal brackets 10. As a result, conventional hanging planters tend to hang off the fence 12 at an angle, as can be seen in FIG. 2 (prior art), which angle is undesirable as it is not aesthetically pleasing and also could allow for the planter box 12 to fall out of the metal brackets 10 of the hanging plant, or cause the metal brackets 10 to be pulled off the fence 12 by the weight of the planter box 12 with its contents, since the planter box 12 is not retained as securely as might otherwise be.

It is an object of the present invention to provide an adjustable planter box hanger capable of supporting a planter box in a desired angular orientation.

SUMMARY OF THE INVENTION

In accordance with one aspect of the present invention, there is provided an adjustable planter box hanger for hanging a planter box at a selected angular position from a support structure having front and rear faces adjoined by a top brim portion. The planter box hanger comprises left and right hanging support brackets, each having a support structure engaging top portion for engaging the top brim portion of a support structure, and terminating in a downwardly turned lip portion for engaging the rear face of a support structure. Each of the left and right hanging support brackets also has a main downwardly depending leg having top and bottom ends and depending from the support structure engaging top portion, and an outwardly projecting support arm for receiving a planter box thereon. The outwardly projecting support arm terminates in an upwardly turned lip portion. An angle adjustment member has left and right bracket engagement means terminating at inner ends that are coterminous with and interconnected by a substantially straight cross member, for engaging, in use, the front face of a support structure. Each of the left and right bracket engagement means extends forwardly from the cross member. The left and right bracket engagement means are engagable forwardly and rearwardly along the bracket engagement means in selectively adjustable relation with the respective left and right hanging support brackets, such that any one of a plurality of fore and aft support positions can be selected, whereby each left and right hanging support bracket is displaced a selected distance from the front face of a support structure, thus permitting the downwardly depending leg to be disposed substantially vertically and the outwardly projecting support arm to be disposed substantially horizontally.

DETAILED DESCRIPTION OF THE PREFERRED EMBODIMENTS

Reference will now be made to FIGS. 3 through 9, which Figures show a preferred embodiment of the adjustable planter box hanger of the present invention, as indicated by the general reference numeral 20. The adjustable planter box hanger 20 is for hanging a planter box 22—shown in dashed outline—at a selected angular position from a support structure 24—also shown in dashed outline—such as a fence or a garden wall, which support structure 24 has a front face 26 and rear face 28 adjoined by a top brim portion 29.

The adjustable planter box hanger 20 comprises left and right hanging support brackets 30, which left and right hanging support brackets 30 are substantially identical one to the other. For the sake of convenience, generally only one support bracket 30 will be described in the following description.

Each support bracket 30 has a support structure engaging top portion 32 for engaging the top brim portion 29 of the support structure 24, such as a fence or a garden wall, and the like, and terminate in a downwardly turned lip portion 34 for engaging the rear face 28 of the support structure 24. In the preferred embodiment, but not necessarily, each of the support structure engaging top portions 32 comprises a stationary portion 36 and a moveable portion 38 retained in selectively securable overlapping relation with respect to the stationary portion 36 by means of a cooperating threaded fastener, namely bolt 40 and wing nut 42. The bolt 40 is disposed through respective aligned apertures 44 and 46 in the stationary and moveable portions 36 and 38, respectively, and is securely fastened in place by the wing nut 42. In order to adjust the length of the support structure engaging top portion 32, the wing nut 42 is loosened with respect to the bolt 40, the moveable portion 38 is moved with respect to the respective stationary portion 36 to a selected position, and the wing nut 42 is subsequently tightened. The support structure engaging top portions 32 are thereby adjustable in length to accommodate various widths of support structures 24.

Each support bracket 30 also has a main downwardly depending leg 50 having top and bottom ends 52 and 54 depending from the support structure engaging top portion 32. The main downwardly depending leg 50 is preferably a single solid piece of material, since the main downwardly depending legs 50 together support the weight of a planter box 22 and its contents, which is typically quite substantial, perhaps as much as fifty pounds, or even more.

Disposed near the bottom end 54 of said main downwardly depending leg 50 is an outwardly projecting support arm, as indicated by the general reference numeral 60, for receiving a planter box 22 thereon. Preferably, each outwardly projecting support arm 60 comprises a stationary portion 62 and moveable portion 64. The stationary portion 62 is securely attached to the downwardly depending leg 50, typically by means or welding, or any other suitable means, and has a plurality of detents 66 therein spaced apart along the length of the stationary portion 62, as can best be seen in FIG. 8. The detents 66 are preferably formed in the stationary portion 62 by means of stamping, for reasons of simplicity and economy of manufacture. The moveable portion 64 of the outwardly projecting support arm 60 is slidably engaged on the stationary portion 62, and is retained thereon by means of two opposed hooked tabs 68, as can best be seen in FIGS. 4, 8 and 9. The moveable portion 64 has a stop portion 70 shaped and dimensioned for cooperating engagement with the detents 66, as can best be seen in FIG. 8. The stop portion 70 of the moveable portion 64 of the outwardly projecting support arm 60 is also preferably formed by means of stamping, for the same reasons. Each outwardly projecting support arm 60 is thereby adjustable in length, in order to accommodate different widths of planter boxes 22.

In order to re-inforce the outwardly projecting support arms 60, each of the support brackets 30 of the adjustable planter box hanger 20 further comprises a bracing member 72 securely interconnected in weight bearing-relation between the bottom end 54 of the downwardly depending leg 50 and the stationary portion 62 of the outwardly projecting support arm 60. In the preferred embodiment, the bracing member 72 is an integral extension of the main downwardly depending leg 50, again for reasons of simplicity and economy of manufacture.

Figure 3:
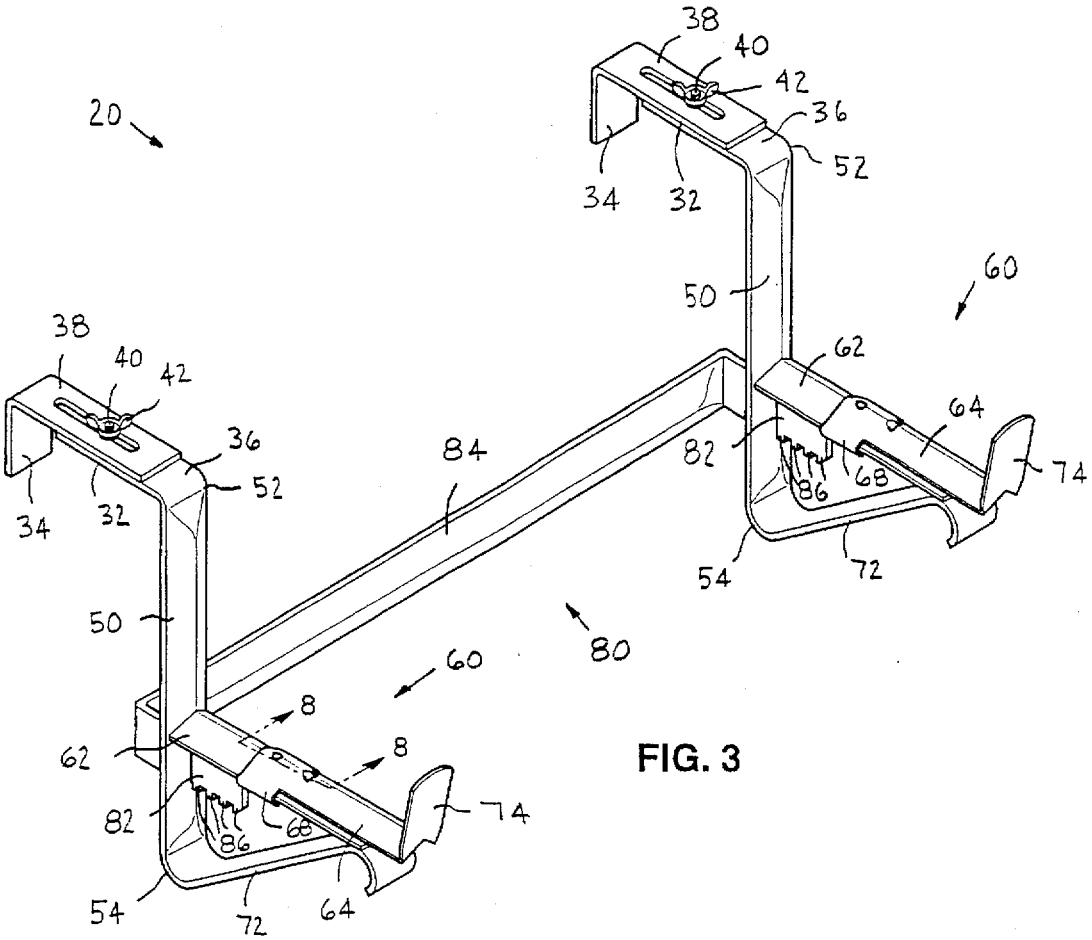
FIG. 3 is a perspective view of the adjustable planter box hanger of the present invention.
Figure 4:
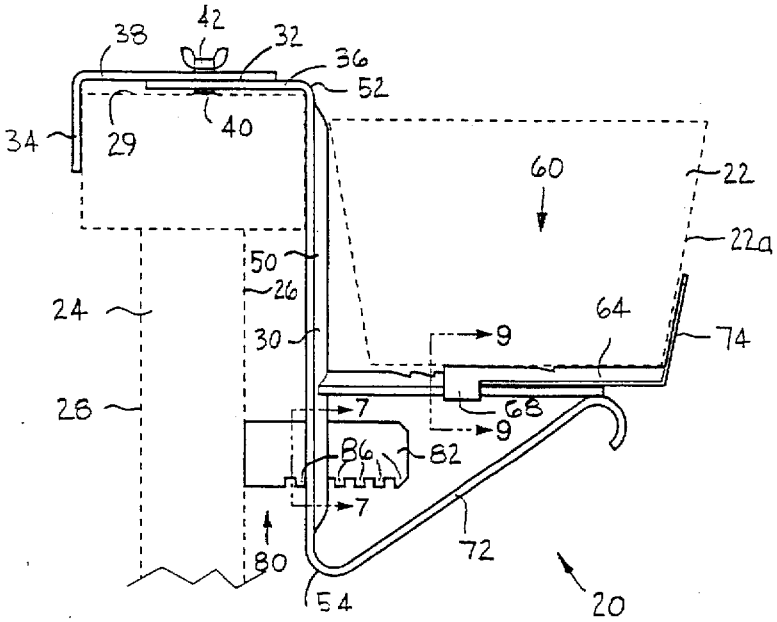
FIG. 4 is a side elevational view of the adjustable planter box hanger of FIG. 3, shown mounted on a fence and supporting a planter box.
Figure 5:
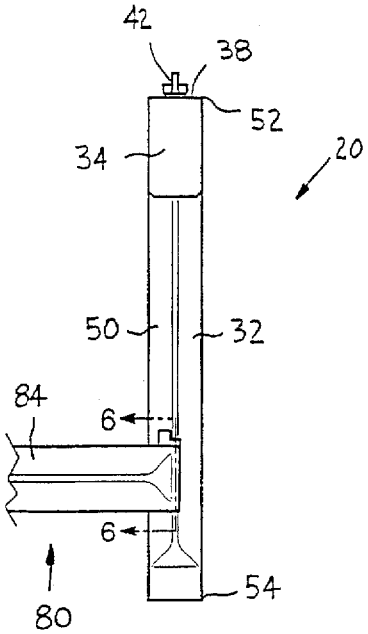
FIG. 5 is an elevational view from the rear of one end portion of the adjustable planter box hanger of FIG. 3.

The moveable portion 64 of the outwardly projecting support arm 60 terminates in an upwardly turned lip portion 74, as can best be seen in FIGS. 3 and 4. The upwardly turned lip portion 74 abuts against the outer face **22*a* of the planter box 22, so as to snugly retain the planter box 22 in place in the adjustable planter box hanger 20**.

An angle adjustment member, as indicated by the general reference numeral 80, has left and right bracket engagement means, each designated by the reference numeral 82 as they are substantially identical one to the other, which preferably comprise a tongue portion 82 that is substantially vertically disposed along its height. Each of the left and right bracket engagement means 82—tongue portions 82 having a length "L"—terminate at inner ends that are coterminous with and interconnected by a substantially straight cross member 84, and extend forwardly from the cross member 84 into engagement with the respective left and right hanging support brackets 30. In the preferred embodiment, the left and right bracket engagement means 82 and the substantially straight cross member 84 are formed from a single elongate piece of metal. The substantially straight cross member 84 is stamped to have a substantially "V"-shaped cross-section, to achieve increased strength. In use, the substantially straight cross member 84 engages the front face 26 of the support structure 24.

In the preferred embodiment, the tongue portions 82 each have a row of teeth 86 disposed thereon along the length "L" thereof, at a bottom edge of the respective tongue portion 82. As can be best seen in FIG. 6, the tongue portions 82 have an overall height "O", inclusive of the teeth 86, and a partial height "P", exclusive of the teeth 86. As can be best seen in FIG. 7A, the tongue portions 82 also have a thickness "T", which thickness "T" is substantially constant.

Figure 7A:
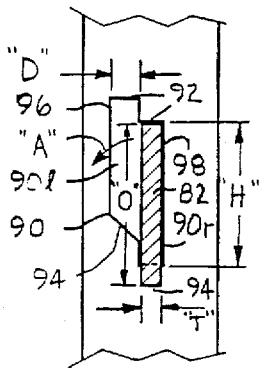
FIG. 7A is an enlarged sectional side view of the adjustable planter box hanger of FIG. 3, taken along section line 7—7, showing the bracket engagement means of the angle adjustment member in a locked position.
Figure 7B:
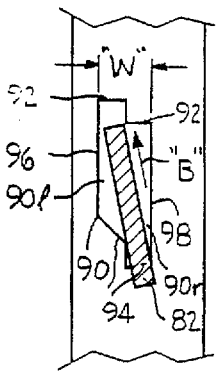
FIG. 7B is a view similar to FIG. 7A, but showing the bracket engagement means of the angle adjustment member in an intermediate position.
Figure 7C:
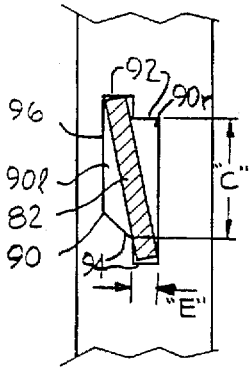
FIG. 7C is a view similar to FIG. 7A, but showing the bracket engagement means of the angle adjustment member in an adjustment position.
Figure 8:
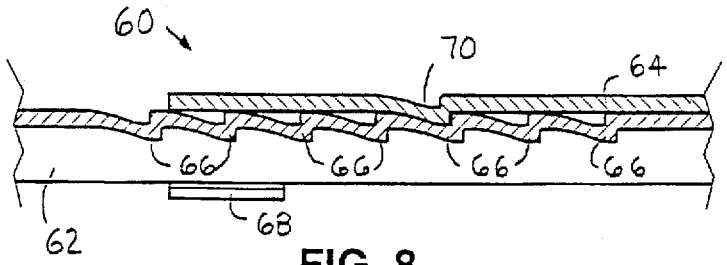
FIG. 8 is an enlarged sectional side view of the adjustable planter box hanger of FIG. 3, taken along section line 8—8; and, FIG. 9 is an enlarged sectional side view of the adjustable planter box hanger of FIG. 3, taken along section line 9—9.
Figure 9:
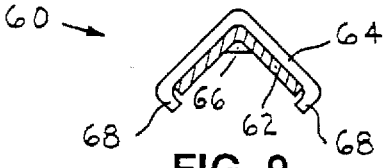

Each of the left and right hanging support brackets 30 is provided with a tongue receiving aperture 90, as can be best seen in FIGS. 7A through 7C, having a height "H" defined by a top edge 92 and bottom edge 94, wherein the height "H" is and greater in dimension than the height "O" of the tongue portion 82, and an overall width "W" defined by a left edge 96 and a right edge 98, wherein the overall width "W" is greater than the thickness "T" of the tongue portion 82. Each tongue receiving aperture 90 comprises adjoined left and right portions **90*l* and 90*r*, which are vertically offset one from the other, with the upper of the left and right portions 90*l* and 90*r* having a width "D" at the top edge 92 greater than the thickness "T" and the lower of the left and right portions 90*l* and 90*r* having a width "E" at the bottom edge 94 greater than the thickness "T". The height of the lower of the left and right portions 90*l* and 90*r*—the right portion in the preferred embodiment—is less than the overall height "O" and greater than the partial height "P", for reasons that will be discussed subsequently. The bottom edge 94 of the tongue receiving aperture 90 at the upper of the left and right portions 90*l* and 90*r* is vertically offset from the top edge 92 of the tongue receiving aperture 90 at the lower of the left and right portions 90*l* and 90*r* by a distance "C" which is less than the partial height "P". Thus, when the tongue portion 82 is in a locked position as shown in FIG. 7A, it cannot be lifted directly upwardly a distance sufficient to disengage the teeth 86 from the main downwardly depending leg 50 at the bottom edge 94 of the tongue receiving aperture 90. Each of the tongue receiving apertures 90 is thereby shaped and dimensioned to receive the respective tongue portion 82** in locking engagement.

Figure 6:
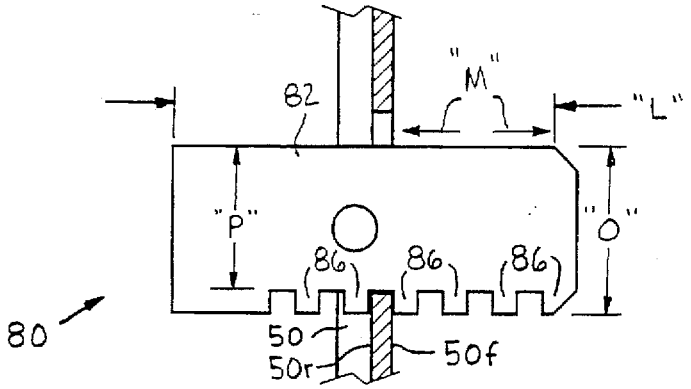
FIG. 6 is an enlarged sectional side view of the adjustable planter box hanger of FIG. 3, taken along section line 6—6.

In use, when the adjustable planter box hanger 20 is hung from a supporting structure and is supporting a planter box 22, the left and right bracket engagement means 82—tongue portions 82—engage in selectively adjustable relation with the respective left and right hanging support brackets through the tongue receiving aperture 90, such that two consecutive teeth 86 are disposed one on each face **50*f* and 50*r* of the respective main downwardly depending leg 50, below the level of the bottom edge 94 of the lower of the left and right portions 90*l* and 90*r*—the right portion 90*r* in the preferred embodiment—of the tongue receiving aperture 90, as can be best seen in FIGS. 6 and 7A. As such, the adjustable planter box hanger 20 is in its weight supporting configuration, wherein a planter box 22 may readily be supported. As can be seen in FIG. 7A, the tongue portion 82 cannot be lifted within the tongue receiving aperture 90, as the distance "C" is less than the overall height "O" of the tongue portion 82. Thus, the tongue portion 82** is safely secured in place.

The adjustable planter box hanger 20 of the present invention permits hanging of a planter box 22 at a selected angular position from a support structure 24, through selective fore and aft adjustment of the left and right bracket engagement means 82—tongue portions 82—as will now be described. The left and right tongue portions 82 are engagable forwardly and rearwardly along their respective lengths in selectively adjustable relation with the respective left and right hanging support brackets 30, such that any one of a plurality of fore and aft support positions can be selected. In order to move the tongue portions 82 from any one engagement position to any other engagement position, at which engagement positions the adjustable planter box hanger 20 is in its weight supporting configuration, as shown in FIG. 7A, the tongue portions 82 must be slightly rotated from the position as shown in FIG. 7A, to an intermediate position shown in FIG. 7B, as indicated by arrow "A". Since the height "H" of the tongue receiving aperture 90 is greater than the overall height "O" of the tongue portion 82, it can be lifted directly upwardly a distance sufficient to disengage the teeth 86 from the main downwardly depending leg 50 at the bottom edge 94 of the tongue receiving aperture 90, as indicated by arrow "B" in FIG. 7B, until the tongue portion 82 is in an adjustment position as shown in FIG. 7C. It can be seen that the tongue portions 82 are then engagable forwardly and rearwardly along its length "L" in selectively adjustable relation with the respective left and right hanging support brackets 30, such that any one of a plurality of fore and aft positions can be selected, as indicated by arrows "M" in FIG. 6. In this manner, each left and right hanging support bracket 30 may be displaced a selected distance from the front face 26 of a support structure 24, thus permitting the downwardly depending leg 50 to be disposed substantially vertically and the outwardly projecting support arm 60 to be disposed substantially horizontally, so as to cause hanging of a planter box 22 at a selected angular position from a support structure 24.

Other modifications and alterations may be used in the design and manufacture of the apparatus of the present invention without departing from the spirit and scope of the accompanying claims.

What is claimed is:

1. An adjustable planter box hanger for hanging a planter box at a selected angular position from a support structure having front and rear faces adjoined by a top brim portion, said planter box hanger comprising:

left and right hanging support brackets, each having a support structure engaging top portion for engaging said top brim portion of a support structure, and terminating in a downwardly turned lip portion for engaging the rear face of a support structure; a main downwardly depending leg having top and bottom ends and depending from said support structure engaging top portion; and an outwardly projecting support arm for receiving a planter box thereon, said outwardly projecting support arm terminating in an upwardly turned lip portion;

an angle adjustment member having left and right bracket engagement means terminating at inner ends that are coterminous with and interconnected by a substantially straight cross member, for engaging, in use, the front face of a support structure; each of said left and right bracket engagement means extending forwardly from said cross member;

wherein said left and right bracket engagement means are engagable forwardly and rearwardly along said bracket engagement means in selectively adjustable relation with the respective left and right hanging support brackets, such that any one of a plurality of fore and aft support positions can be selected, whereby each left and right hanging support bracket is displaced a selected distance from the front face of a support structure, thus permitting said downwardly depending leg to be disposed substantially vertically and said outwardly projecting support arm to be disposed substantially horizontally.

2. The adjustable planter box hanger of claim 1, wherein said each of said left and right bracket engagement means comprises a tongue portion having a length "L" and a row of teeth disposed thereon along said length "L", an overall height "O" inclusive of said teeth, a partial height "P" exclusive of said teeth, and a thickness "T"; and wherein each of said left and right support brackets is provided with a tongue receiving aperture having a height "H" defined by a top edge and bottom edge, wherein said height "H" is greater in dimension than said height "O"; and an overall width "W" defined by a left edge and a right edge, wherein said overall width "W" is greater than said thickness "T";

whereby each of said tongue receiving apertures is shaped and dimensioned to receive said tongue portion in locking engagement.

3. The adjustable planter box hanger of claim 2, wherein said tongue portion is substantially vertically disposed along its height.

4. The adjustable planter box hanger of claim 3, wherein said teeth are disposed along a bottom edge of said tongue portion.

5. The adjustable planter box hanger of claim 4, wherein each tongue receiving aperture comprises adjoined left and right portions which are vertically offset one from the other, with the upper one of said left and right portions having a width "D" at said top edge greater than said thickness "T", and the lower of said left and right portions having a width "E" at said bottom edge greater than said thickness "T", and wherein the height of the lower of said left and right portions is less than said overall height "O" and greater than said partial height "P".

6. The adjustable planter box hanger of claim 5, wherein said bottom edge of said tongue receiving aperture at the upper of said left and right portions is vertically offset from said top edge of said tongue receiving aperture at the lower of said left and right portions by a distance "C" which is less than said partial height "P".

7. The adjustable planter box hanger of claim 4, wherein each outwardly projecting support arm is adjustable in length.

8. The adjustable planter box hanger of claim 7, wherein each outwardly projecting support arm comprises a stationary portion securely attached to said downwardly depending leg and having a plurality of detents therein along the length of said stationary portion, and a moveable portion slidably engaged on said stationary portion and having a stop portion shaped and dimensioned for cooperating engagement with said detents.

9. The adjustable planter box hanger of claim 8, further comprising a bracing member securely interconnected in weight bearing-relation between said bottom end of said downwardly depending leg and said stationary overlapping portion of said outwardly projecting support arm.

10. The adjustable planter box hanger of claim 9, wherein each of said support structure engaging top portions is adjustable in length.

11. The adjustable planter box hanger of claim 10, wherein each of said support structure engaging top portions comprises a stationary portion secured to said downwardly depending leg at the top end thereof and a moveable portion retained in selectively securable overlapping relation with respect to said stationary portion by means of cooperating threaded fasteners disposed through respective apertures in each of said stationary and moveable portions.

* * * * *